US006237761B1

(12) United States Patent
Godshaw et al.

(10) Patent No.: US 6,237,761 B1
(45) Date of Patent: May 29, 2001

(54) PACKING CASE FOR FOLDABLE ARTICLES

(75) Inventors: Donald E. Godshaw, Evanston; Andrezj Redzisz, Skokie, both of IL (US)

(73) Assignee: Travel Caddy, Inc., Des Plaines, IL (US)

( * ) Notice: Subject to any disclaimer, the term of this patent is extended or adjusted under 35 U.S.C. 154(b) by 0 days.

(21) Appl. No.: 09/248,390

(22) Filed: Feb. 12, 1999

(51) Int. Cl.[7] ..... A45C 13/02

(52) U.S. Cl. ..... 206/297; 206/278; 206/292; 229/87.15

(58) Field of Search ..... 206/278, 287, 206/287.1, 292, 297, 298; 229/87.15; 190/13 C, 107, 109

(56) References Cited

U.S. PATENT DOCUMENTS

| | | | | |
|---|---|---|---|---|
| 222,614 | | 12/1879 | Weaver . | |
| 258,844 | | 5/1882 | Young . | |
| 485,509 | | 11/1892 | Speed . | |
| 862,154 | | 8/1907 | Greenawalt . | |
| 885,721 | | 4/1908 | Cave . | |
| 1,114,913 | | 10/1914 | Riles . | |
| 1,134,285 | | 4/1915 | Page . | |
| 1,215,868 | | 2/1917 | Rosenfeld . | |
| 1,385,695 | | 7/1921 | MacCormack et al. . | |
| 1,474,826 | | 11/1923 | Hudec . | |
| 1,604,090 | | 10/1926 | Wolfson . | |
| 1,641,747 | * | 9/1927 | Doud | 229/87.15 X |
| 1,668,572 | | 5/1928 | Parmele . | |
| 1,720,679 | * | 7/1929 | Karn | 229/87.15 X |
| 1,754,663 | * | 4/1930 | Adams | 190/115 |
| 1,872,936 | * | 8/1932 | Gosch | 229/87.15 X |
| 1,975,294 | * | 10/1934 | Sand et al. | 190/107 X |
| 2,175,387 | | 10/1939 | Goding . | |
| 2,226,231 | | 12/1940 | Morse . | |
| 2,269,915 | | 1/1942 | Porter . | |
| 2,288,867 | * | 7/1942 | Meyer et al. | 206/287 X |
| 2,443,702 | | 6/1948 | Bruning . | |
| 2,467,421 | * | 4/1949 | Blazek | 206/292 X |
| 2,508,579 | * | 5/1950 | McFall | 206/292 X |
| 2,521,529 | | 9/1950 | Mauney . | |
| 2,632,564 | | 3/1953 | Bloom . | |
| 2,745,544 | | 5/1956 | Folk . | |
| 3,024,824 | | 3/1962 | Bass . | |
| 3,056,490 | * | 10/1962 | Teetor | 206/298 |
| 3,085,725 | | 4/1963 | Caparosa . | |
| 3,511,364 | | 5/1970 | Airdo . | |
| 3,570,570 | * | 3/1971 | Winner | 190/100 X |
| 3,623,526 | | 11/1971 | Robertson . | |
| 3,886,712 | | 6/1975 | Sylvester . | |
| 4,106,260 | | 8/1978 | King . | |
| 4,139,095 | | 2/1979 | Weaver . | |
| 4,562,952 | | 1/1986 | Chinman . | |
| 4,881,684 | | 11/1989 | Chinman . | |
| 5,174,479 | * | 12/1992 | Dufour | 206/292 X |
| 5,535,880 | * | 7/1996 | Plath | 190/13 C X |
| 5,676,223 | * | 10/1997 | Cunningham | 190/18 A X |

FOREIGN PATENT DOCUMENTS

| | | | | |
|---|---|---|---|---|
| 662144 | * | 7/1938 | (DE) | 206/299 |
| 84297 | * | 11/1964 | (FR) | 206/278 |
| 1507294 | | 11/1967 | (FR) . | |
| 331129 | | 6/1930 | (GB) . | |
| 1596366 | | 8/1981 | (GB) . | |

* cited by examiner

*Primary Examiner*—Sue A. Weaver
(74) *Attorney, Agent, or Firm*—Banner & Witcoff, Ltd.

(57) ABSTRACT

A packing case for foldable articles includes a generally rectangular center section with shaping wings attached on opposite sides of the center section. The shaping wings are generally rigid and form a means to fold an article in a desired fashion over the center section. A rigid retaining flap hinged to the center section may be initially folded over an article of clothing in the center section under the rigid shaping wings. Flexible side retaining wings then fold over the center section from the sides and the opposite end of the center section. Various permutations of the packing case are disclosed.

20 Claims, 17 Drawing Sheets

FIG.21
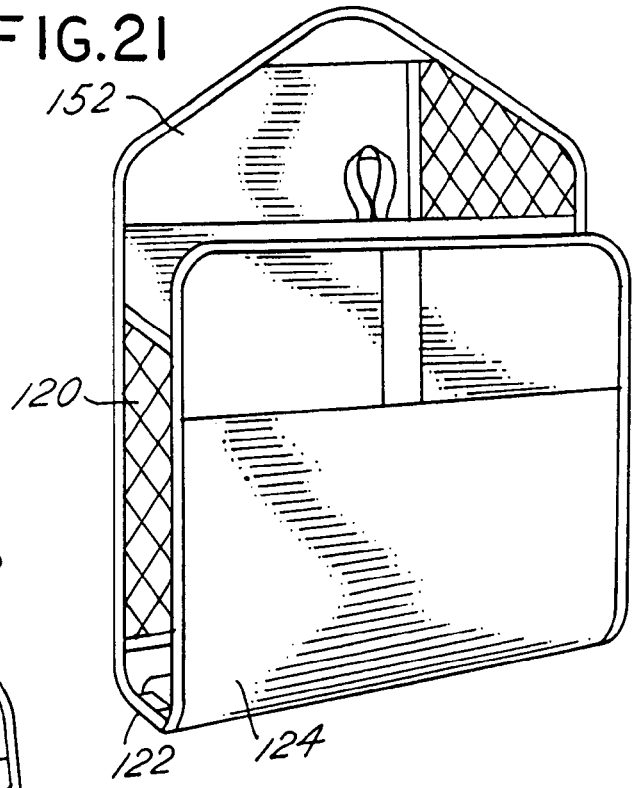
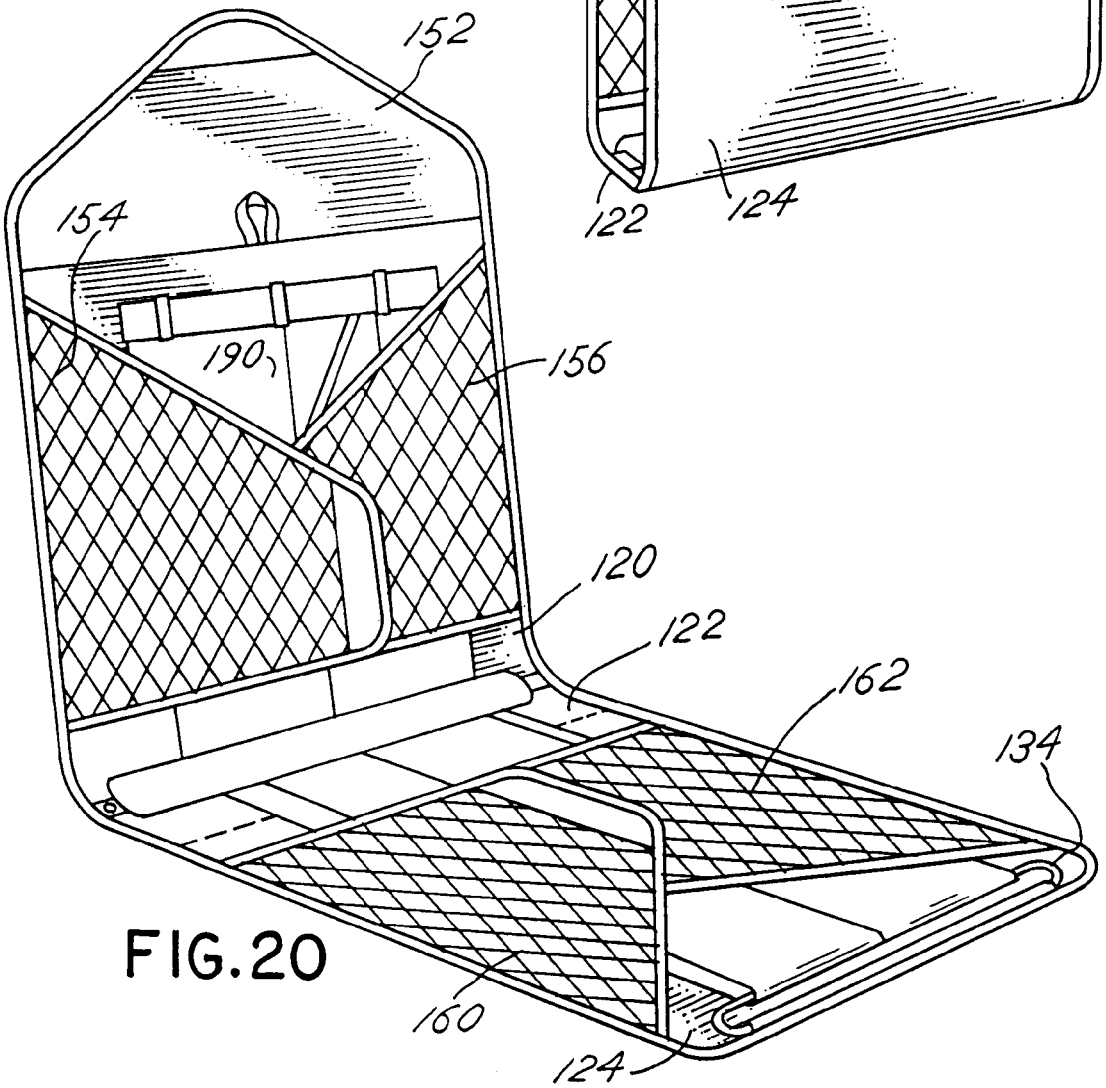
FIG.20

PACKING CASE FOR FOLDABLE ARTICLES

BACKGROUND OF THE INVENTION

In a principal aspect the present invention relates to a case which is especially useful for folding articles such as shirts, trousers, dresses, slacks and the like in a manner which will retain the article of clothing free of wrinkles and available for storage, for packing in a larger case or suitcase or for transport in the packing case in which the article is folded.

A problem often encountered when traveling relates to packing of articles of clothing such as dress shirts, slacks, dress coats, dresses and other items which, unless folded in a proper fashion, will wrinkle and become untidy, therefore requiring pressing or other attention before they can be worn. Various systems are utilized in suitcases, packing cases and the like in an attempt to maintain the press or wrinkle-free condition of clothing articles. Suitcases often include flaps or similar elements which serve as a pattern or support which permits or facilitates folding of the items.

In U.S. Pat. No. 4,562,952, issued Jan. 7, 1986, a wrapper for clothing and the like is disclosed. The device disclosed includes a shape retainer separate and apart from a wrapping assembly or wrapper. Articles of clothing are folded about the shape retainer. The shape retainer is then removed. The folded article is then positioned in the wrapper and the shape retainer is placed over the article. The shape retainer has a geometric shape which is the same as the center portion of the separate wrapper but of lesser dimension. Wing sections are folded over folded articles and the shape retainer.

While such a wrapper device appears to be utilitarian, it does not resolve problems associated with packing various items such as shirts with collars, dresses with shoulder pads, and other articles of clothing. Further, the shape retainer which serves as a form for folding the article of clothing may be lost or misplaced.

Thus there has developed a need for a more universal carrying and packing case and method which may serve not only as a means for holding and packing articles of clothing so that they will remain wrinkle free but also to serve as a packing case for the articles of clothing if necessary.

SUMMARY OF THE INVENTION

Briefly, the present invention comprises a packing case for foldable articles which in one embodiment includes an envelope assembly having a generally rigid rectangular center section with rigid shaping wings foldably attached to opposite sides of the center section. The shaping wings may be positioned to serve as a pattern for an article of clothing which is placed on the center section of the packing case. Flexible side retainer wings are then foldable over the center section to retain all of the elements as a package. A fold form and retainer member is optionally attached to the center section along the top edge of the center section. The retainer member generally has a configuration or shape which is distinct from that of the center section of the envelope and dimensions which are equal to or greater than the center section. The center section is generally rectangular. Retainer members are typically hinged along the top edge of the center section so they may be folded over the center section and a portion of an article such as clothing positioned on the center section. The retainer member typically includes scalloped portions to permit receipt of shirt collars or shoulder pads of a dress. Other cutout forms may be provided to accommodate the clothing article which is being the packed. Various retaining straps and flexible folding wings are provided to retain clothing items in the package. The flexible package elements may be folded one upon the other over the center section and rigid wings to provide an enclosed container or package for the clothing articles.

Thus, it is an object of the invention to provide an improved packaging system and method of packing for articles such as articles of clothing.

It is a further object of the invention is to provide an improved packaging case which includes various elements that facilitate the folding of articles of clothing and which are attached together as a single integral packing device to facilitate packaging articles of clothing.

A further object of the invention is to provide a compact, lightweight packaging method and device which is economical, easy to carry and easy to utilize when folding clothing articles and which maintains the articles in an unwrinkled condition.

Another object of the invention is to provide a packaging device which may be carried by itself or which may be hung by a strap when articles of clothing are retained therein.

These and other objects, advantages, and features of the invention will be set forth in the detailed description as follows.

BRIEF DESCRIPTION OF THE DRAWING

In the detailed description which follows, reference will be made to the drawing comprised of the following figures:

FIG. 20 is an isometric view of the embodiment of FIG. 19 illustrating the next sequential step in the utilization thereof;

FIG. 21 illustrates the embodiment of FIG. 20 subsequent to the next sequential step in the utilization thereof.

DESCRIPTION OF THE PREFERRED EMBODIMENT

Figure 1:
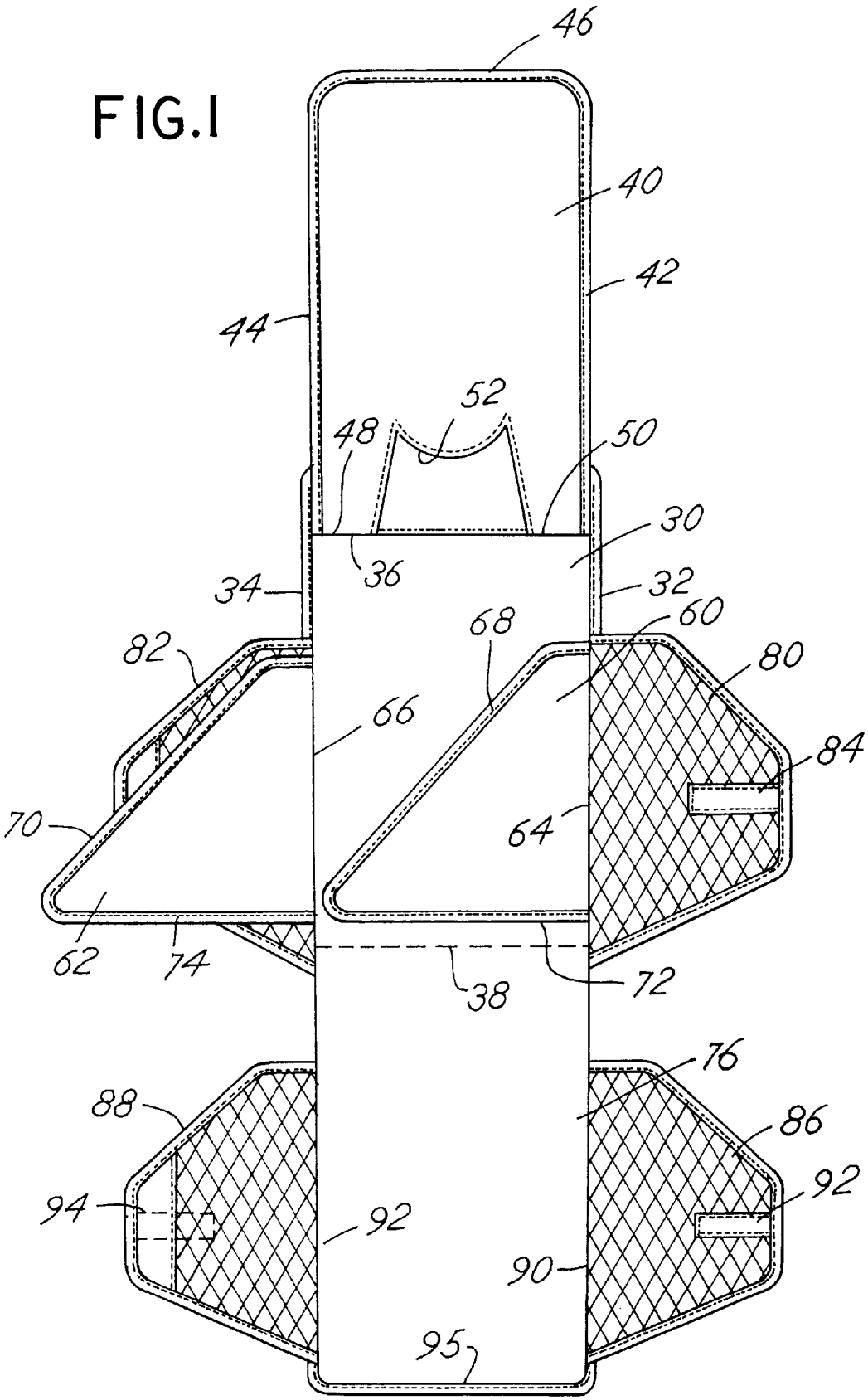
FIG. 1 is a plan view of a first embodiment of the invention, especially adapted for folding of articles such as collared shirts.

FIGS. 1–7 illustrate a first embodiment of the invention;

FIGS. 8–11 illustrate a second embodiment of the invention; FIGS. 12–16 illustrate a third embodiment of the invention; FIGS. 17–22 illustrate a fourth embodiment of the invention.

As noted below, however, there are permutations and combinations of the elements and features of the invention that each of the described embodiments may utilize in combination to provide yet other embodiments of the invention. Thus when describing the four embodiments depicted in the groupings of figures set forth above, it is to be noted that the features of those separate embodiments may be mixed and combined in one or more ways so as to provide the functionality associated with each of the separate described features and elements in other various embodiments not specifically described.

Embodiment of FIGS. 1–7

The embodiment of FIGS. 1–7 is especially useful for the packaging of collared shirts. The embodiment includes a generally rigid rectangular center section 30. The section 30 includes opposite lateral sides 32 and 34, a top edge or side 36 and a bottom edge or side 38. The center section 30 may have an internal board sewn in a cover, for example, in order to provide the rigidity of the center section 30.

Affixed along the top edge 36 of the center section 30 is a form and retainer member or flap 40. The flap 40 has a pair of opposite generally parallel sides 42 and 44 which are separated by a width substantially equal to or greater than the width of the sides 32 and 34 of the center section 30, although the separation of those sides 42, 44 is not necessarily a limiting feature of the invention. In the preferred embodiment, the dimension of the separation of the sides 42 and 44 equals that of the separation of sides 32 and 34. All of sides 32, 34, 42, 44 are generally parallel to one another.

The flap 40 is generally rigid and further includes a free or exposed end 46 and an opposite pair of connecting ends 48 and 50 which are hinged by a flexible hinge member to the top edge 36 of the center section 30. A collared cutout or scallop section 52 is defined in the flap 40. The flap 40 generally has an outer dimension which is equal to or greater than the dimensions of the center section 30 except for the cutout 52. The cutout 52 makes the shape of the flap 40 quite distinct from the shape of the rectangular center section 30.

The opposite sides 32 and 34 of the center section 30 include rigid wings 60 and 62 attached thereto by a flexible hinge such as fabric along the hinge line or connection 64 and 66 respectively. This enables the flaps 60 and 62 to be pivoted along the edges 32 and 34 between the position shown for the flap 60 and the flap 62. The wings or flaps 60 and 62 are generally triangular in shape and include an edge 68 and 70 respectively which is inclined with respect to the sides 32 and 34 respectively. Bottom edge 72 of wing 60 and edge 74 of wing 62 are generally parallel to the bottom edge 38 and, in the preferred embodiment, are aligned with the bottom edge 38 or slightly above the bottom edge 38 within the region defined by the center section 30. The bottom edge 38 is connected to a lower flexible flap 76 which is designed to overlay the entirety of the center section 30. The flap 76 may be rigid or flexible. The connection between the flap 76 and the center section 30, however, is flexible so that the flap 76 may be folded.

Flexible mesh or fabric wings 80 and 82 are provided along and connected to each of the opposite sides 32 and 34. The wings 80 and 82 include fastener strips such as Velcro fastener strips 84 on the inside of the wing 80 and a Velcro strip (not shown) on the outside of the wing 82 so that the strips will permit connection or attachment of the wings 80 and 82 when they are folded one over the other. In practice, the rigid wings 60 and 62 are first folded over an article retained on the center board 30 as discussed with respect to the later figures. Thereafter, the side flexible wings 80 and 82 may be folded.

Lower flexible wings 86 and 88 are attached to sides 90 and 92 of flap 76 and may be likewise folded over flap 76. Wing 86 includes an inner Velcro fastener 92. Wing 88 includes a Velcro fastener 94 on its outside surface.

Figure 2:
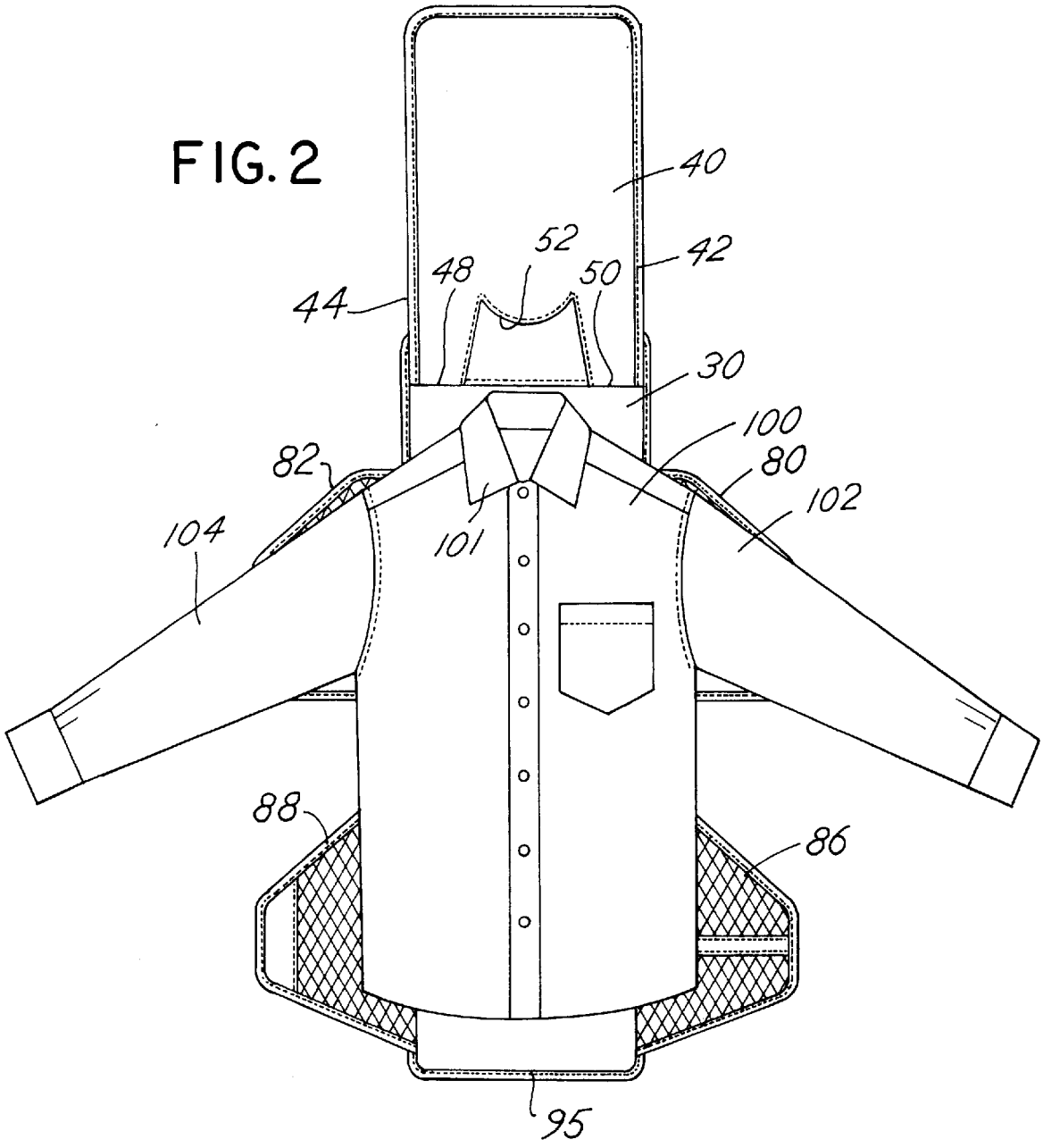
FIG. 2 is a plan view of the package of FIG. 1 wherein a collared shirt has been positioned thereon for packaging and depicts the first step in the utilization of the packing apparatus of FIG. 1.
Figure 3:
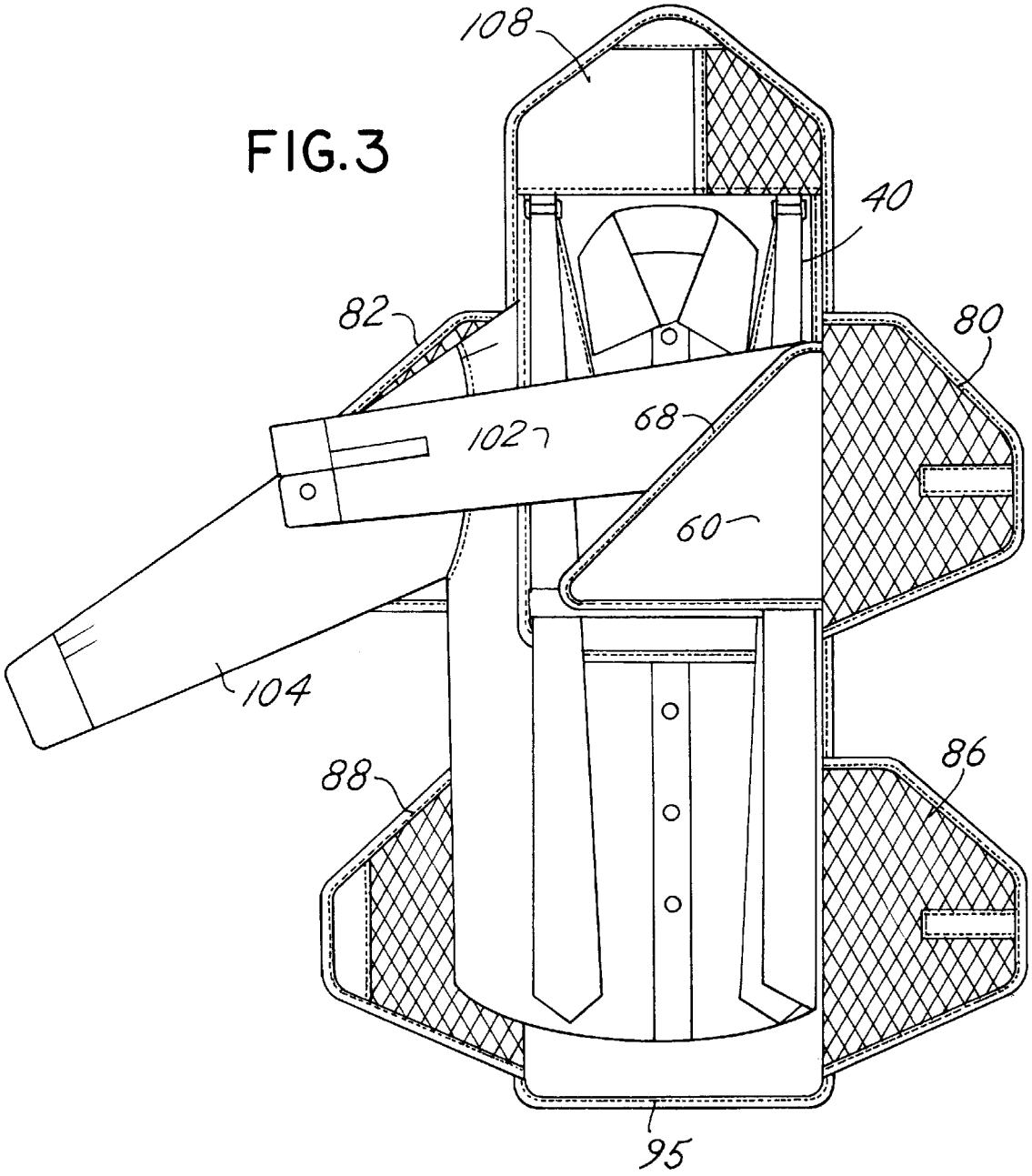
FIG. 3 illustrates in a plan view the next step in the method of use of the packaging apparatus of FIG. 1 in a plan view.

Referring to FIG. 2, there is illustrated the manner of utilization of the packing device of FIG. 1. A shirt 100 having sleeves 102 and 104 is centered on the center section 30. The upper flap 40 is aligned so that the slot 52 will fit over the collar when the flap 40 is placed over the body of the shirt 100. The first step in the packing, then, is the placement of the shirt 100 in the position shown in FIG. 2. Thereafter the flap 40 is folded about the edge connections 48 and 50 to fit over the body of the shirt. Note that more than one shirt may be positioned in the manner depicted. FIG. 3 illustrates the manner in which the flap 40 is positioned over the shirt 100 so that the collar 101 of the shirt remains exposed and flap 40 is surrounded on both sides by portions of the shirt 100 as depicted and described below.

Subsequent to folding of the flap 40 over the shirt 100, the sleeves 102 and 104 are folded over the edges 42 and 44 respectively of the flap 40. Such a fold is depicted with respect to the arm 102 in FIG. 3. Thereafter the rigid wing 60 is folded over the shirt sleeve 102, again as depicted in FIG. 3. The same operation occurs with respect to the arm 104 and flap 62.

Figure 4:
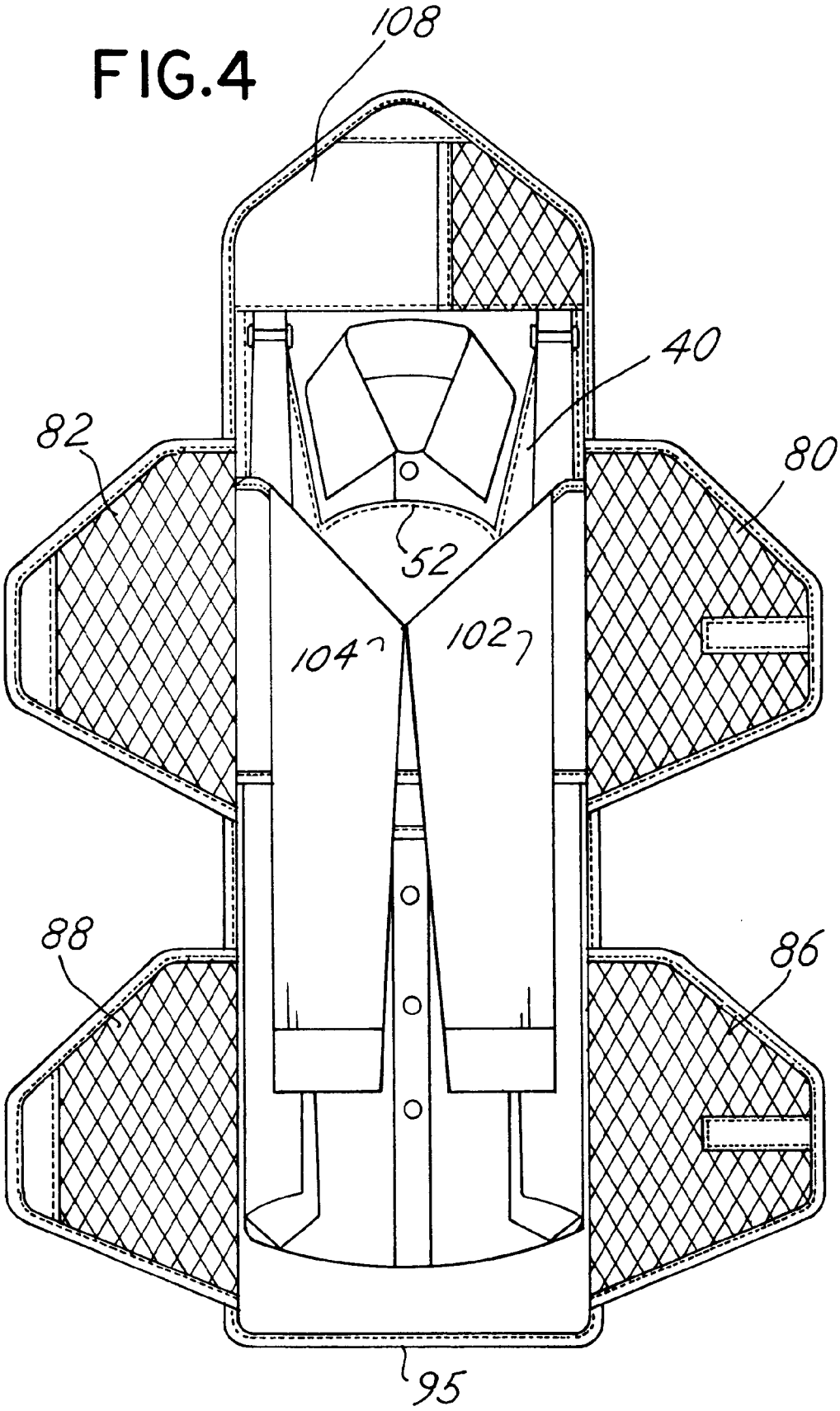
FIG. 4 illustrates in a plan view yet a further step in the utilization of the packaging apparatus of FIG. 1.

Next, referring to FIG. 4, the arm 102 of the shirt is folded against the edge 68 of the wing 60 to the position depicted in FIG. 4. The arm 104 is likewise folded over wing 62. The arms 102 and 104, as well as the body of the shirt 100 and the collar 101, are thus all arranged and fixed in a position for a final folding of the shirt 100 or shirts (in the event of a number of shirts being placed on the center section 30) is effected in the manner depicted in FIG. 5. The flexible side wings 80 and 82 are folded over one another and connected by the Velcro fasteners.

In a similar fashion, the flexible wings or flaps 86 and 88 are folded and connected together over the lower end of the shirt 100. The lower flap 76 may then be folded upwardly over the center section 30 and flap 40. Typically, the lower edge 95 of the flap 76 will then be positioned over the edge 36 of the center section 30. The outside surface of the lower flap 76 includes a Velcro type fastener 105. This fastener 105 cooperates with a companion Velcro fastener 106 on an upper flap 108. Thus Velcro fasteners 106 and 105 may be joined together so that the flap 108, which is affixed to the upper edge 36 of the center section 30, can be folded over to the position depicted in FIG. 7 to effectively totally enclose the package and the contents thereof.

Figure 5:
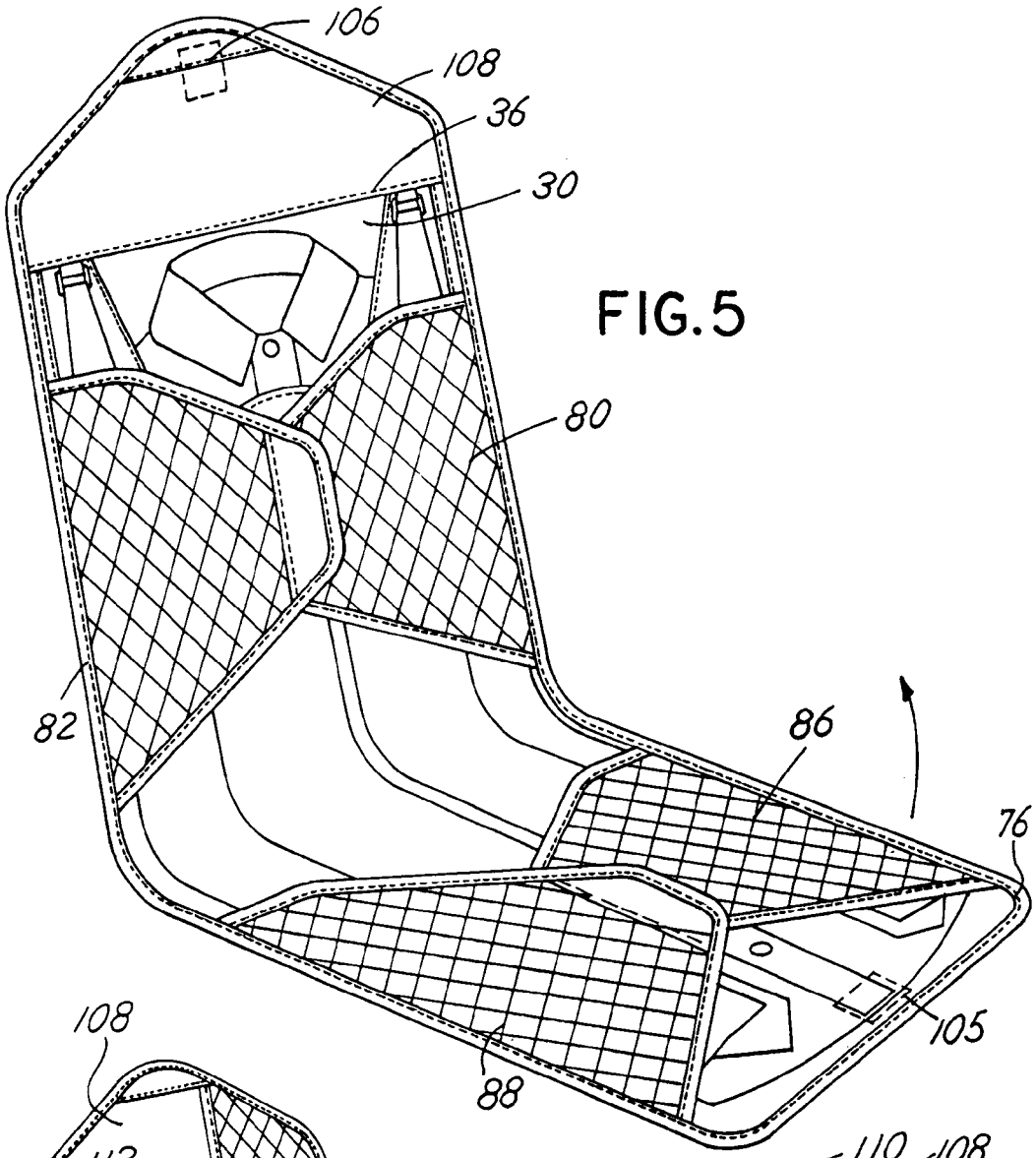
FIG. 5 illustrates in an isometric view a further step in the utilization of the packaging apparatus of FIG. 1.
Figure 6:
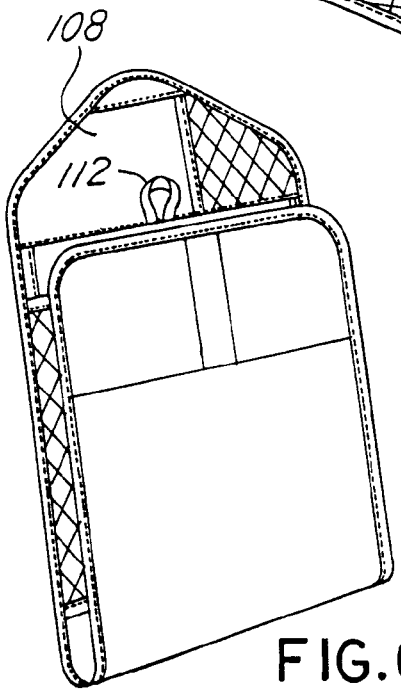
FIG. 6 illustrates an isometric view of the package of FIG. 5 in a substantially folded condition.
Figure 7:
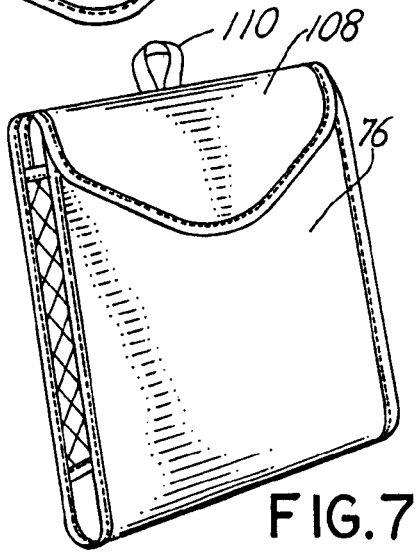
FIG. 7 illustrates in an isometric view the package of FIG. 6 in a totally folded condition.

More than one shirt may be retained within the package. Items other than shirts may be packed. The opening 52, which is a scallop shaped opening for the collar 101 of the shirt, may be of any desired shape to accommodate shirts and items of various size and shape. A hanger strap 110 or wire hanger may be affixed to the outside of the flap 108. The hinges 48 and 50 connecting the flap 40 to the center section 30 may be adjustable and flexible with various lengths in order to accommodate various thicknesses of articles of clothing positioned on the carrier package. As shown in FIG. 6, the assembly will have the configuration depicted prior to movement of the flap 108 over the flap 76. As depicted, it is possible to have a hanger 112 positioned and attached to the seam or edge 36 at the top of the center section 30. This enables the assembly to be hung, for example, as depicted in FIG. 4 or FIG. 5. Various other types of fasteners besides Velcro fasteners may be used to hold the various elements together. Typically, the rigid flap 40 and rigid side wings or flaps 60 and 62 are rigid so as to serve as forms or guides for pressing and maintaining the articles of clothing in combination with the center section 30 in a wrinkle free condition. However, it is possible to utilize flexible members though such use is not preferred.

Embodiment of FIGS. 8–11

The embodiment of FIGS. 8–11 is especially useful for packaging of ladies dresses, for example. In this embodiment, a center section 120 is generally rigid and generally rectangular in shape. The center section 120 is connected by means of a generally rectangular connecting, flexible section 122 to a second either flexible or rigid section 124 which is foldable over the section 120 as discussed in further detail below. The sections 120, 122 and 124 include lateral sides 126 and 128 which is spaced one from the other and are equally spaced along their entire length or parallel. The general outer dimension of the section 124 is greater than that of the section 120 in the preferred embodiment. Connected to section 122 on opposite sides 126 and 128 is a retaining belt or strap 130 and 132 respectively which facilitates retention of items on the sections 120, 122 and 124 as described. A loop, such as a wire loop 134, is attached to lower edge 136 of section 124. The loop 134 includes a loop detent 138 to facilitate manual gripping and pivoting of the loop 134. The loop 134 may thus be inserted through a retainer passage 140 at the lower edge 136 so that the loop 134 may be moved or pivoted in the retainer passage.

The center section 120 includes an upper edge 142 having a flap 144 attached thereto. Flap 144 is configured in a unique manner so that it will facilitate the folding of items such as dresses. The flap 144 thus includes side scallops 146 and 148 and a lower edge 150. The flap 144 is attached to the top section or center section 120 along the connection line or top edge 142. Also attached thereto and pivotal about the same edge 142 is an outer flap 152 which is generally flexible. Attached to the opposite side edges 126 and 128 are a first flexible wing or flap 154 and a second wing 156 respectively. Wings 154 and 156 fold over one another in the manner of the flexible wings described with respect to the first embodiment. The wings 154, 156 include Velcro strips such as strips 158 for fastening the wings 154, 156 together. A second set of wings 160 and 162 are provided attached to the sides 126 and 128 respectively of the section 124. Again, the wings or flexible flaps 162 and 160 fold over and connect together in the manner previously described.

Figure 8:
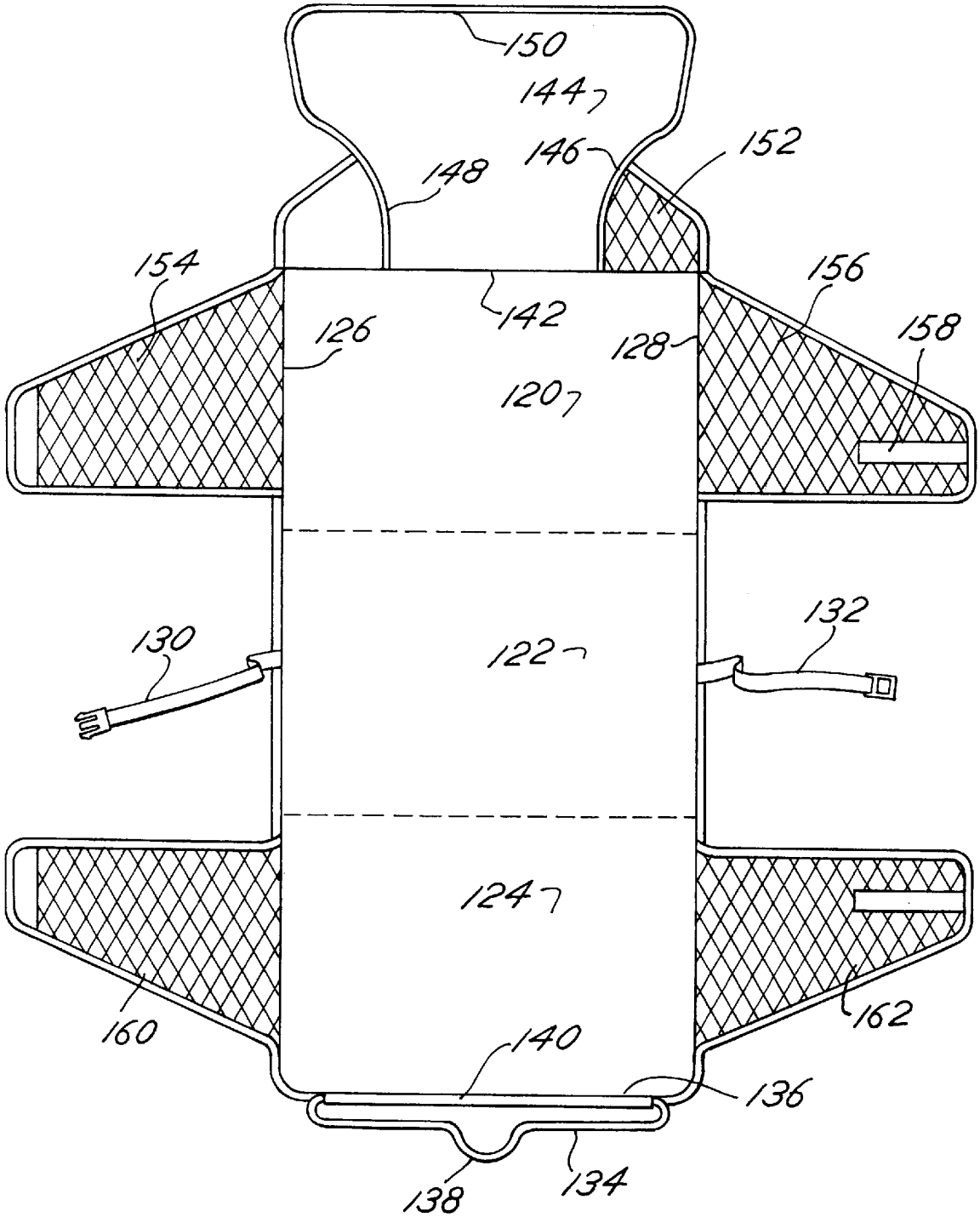
FIG. 8 is a plan view of a second embodiment of the invention, especially designed for packaging of dresses.
Figure 9:
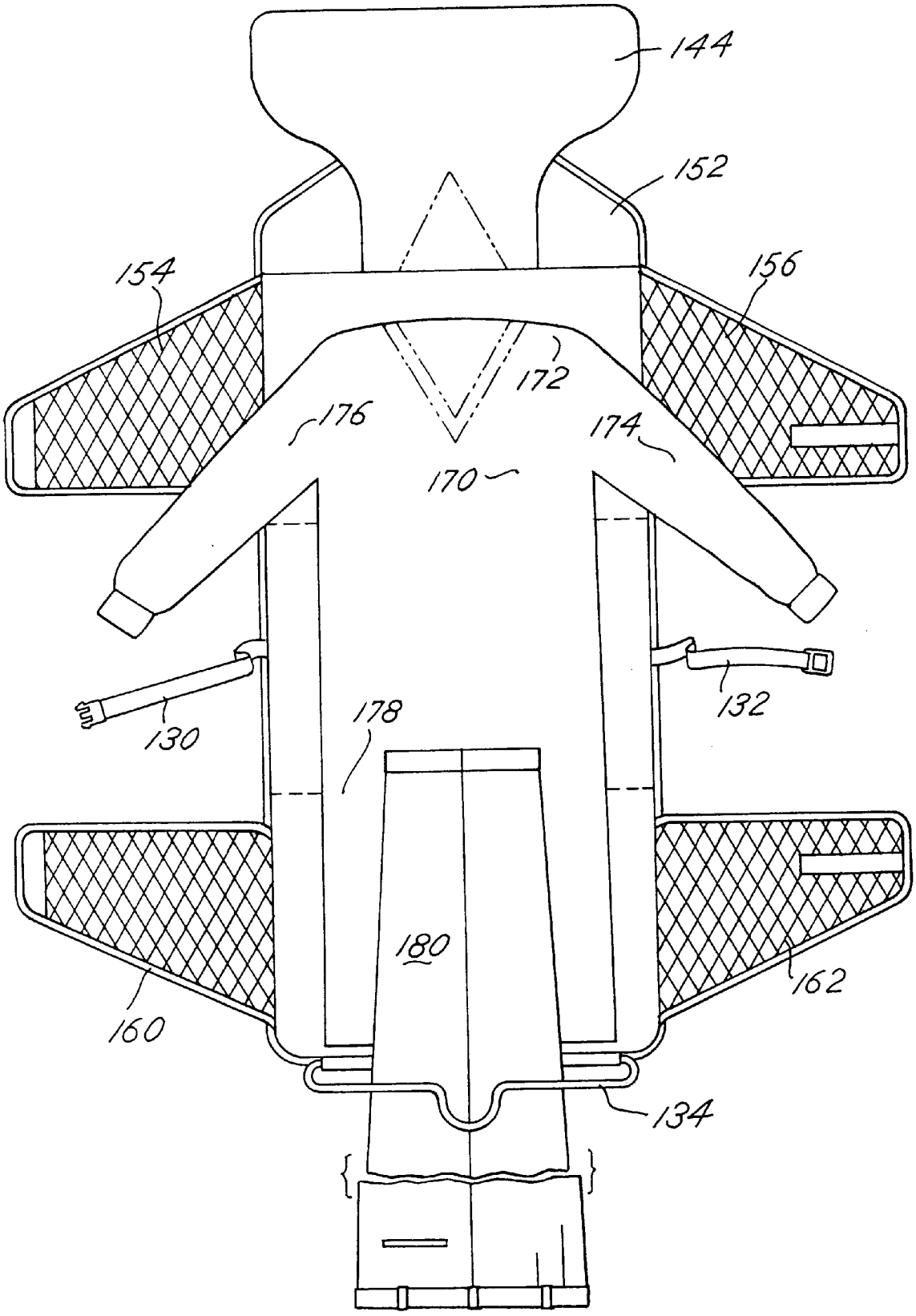
FIG. 9 is a plan or elevation view of the embodiment of FIG. 8 wherein a dress and a pair of slacks have been positioned thereon for subsequent folding.
Figure 10:
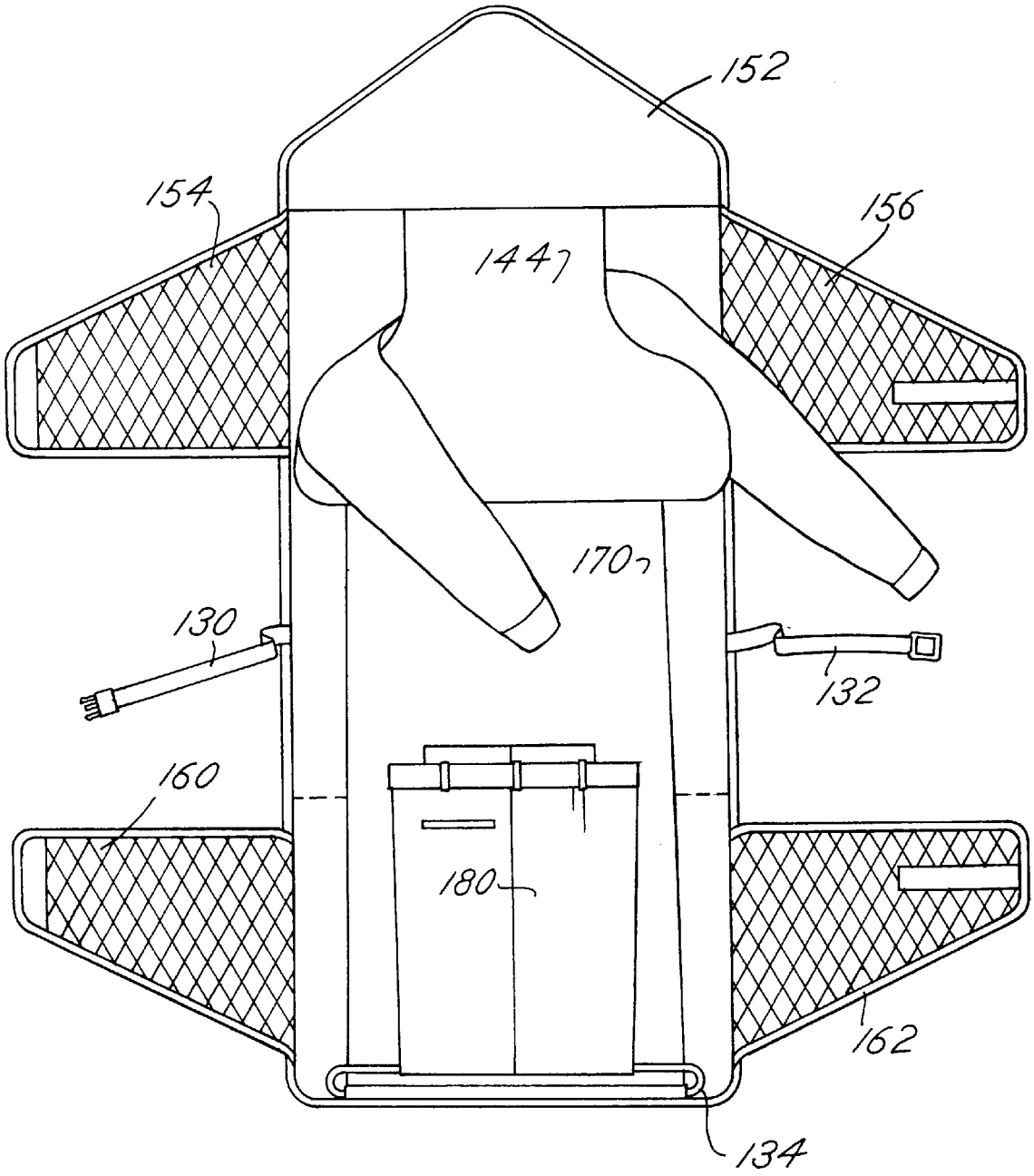
FIG. 10 is a plan view illustrating a next sequential step in the utilization of the embodiment of FIG. 8.
Figure 11:
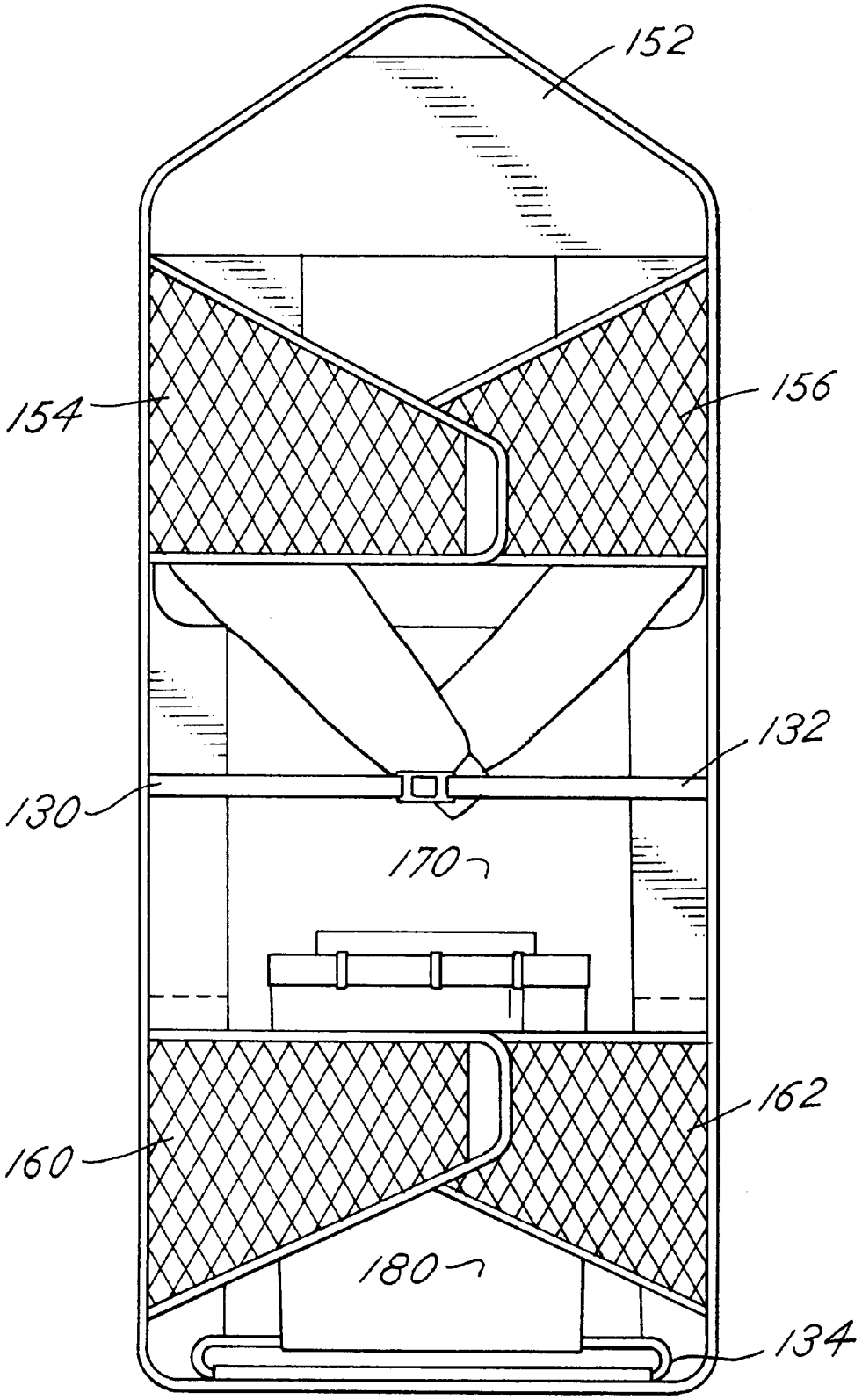
FIG. 11 illustrates in a plan view the next sequential step in the use of the embodiment of FIG. 8.

FIG. 9 depicts the manner in which an item of clothes may be positioned on the embodiment of FIG. 8. A dress 170 may thus be positioned with the neck portion 172 and arm portions 174, 176 of the dress on the center section 120. The skirt section 178 of the dress thus fits over the remaining sections 122 and 124. Optionally or additionally a pair of slacks 180 may be positioned through the loop 134 and then folded over the loop 134 as depicted in FIG. 10. The upper scallop flap 144 is folded over the neck 172 of the dress. The arms 176 and 174 may then be folded over and through the scallop section 148 and 146 respectively as depicted in FIG. 10. Subsequently, as depicted in FIG. 11, the straps 130 and 132 may be connected. Additionally, the flexible wings or flaps 154 and 156, as well as wings 160 and 162, may be folded and connected to each other. The lower section 124 may then be folded over the upper section 120 and the top flap 152 engaged against or folded and connected to the outside of the bottom section 124 in a manner similar to that of the previously described embodiment. Various types of scallops and shapes of the flap 144 are possible. Preferably the flap 144 is a stiff or rigid member to provide a pressing surface against a dress to maintain it wrinkle free and to help facilitate maintaining the arms and other portions of the dress wrinkle free as the assembly is folded.

Embodiment of FIGS. 12–16

Figure 12:
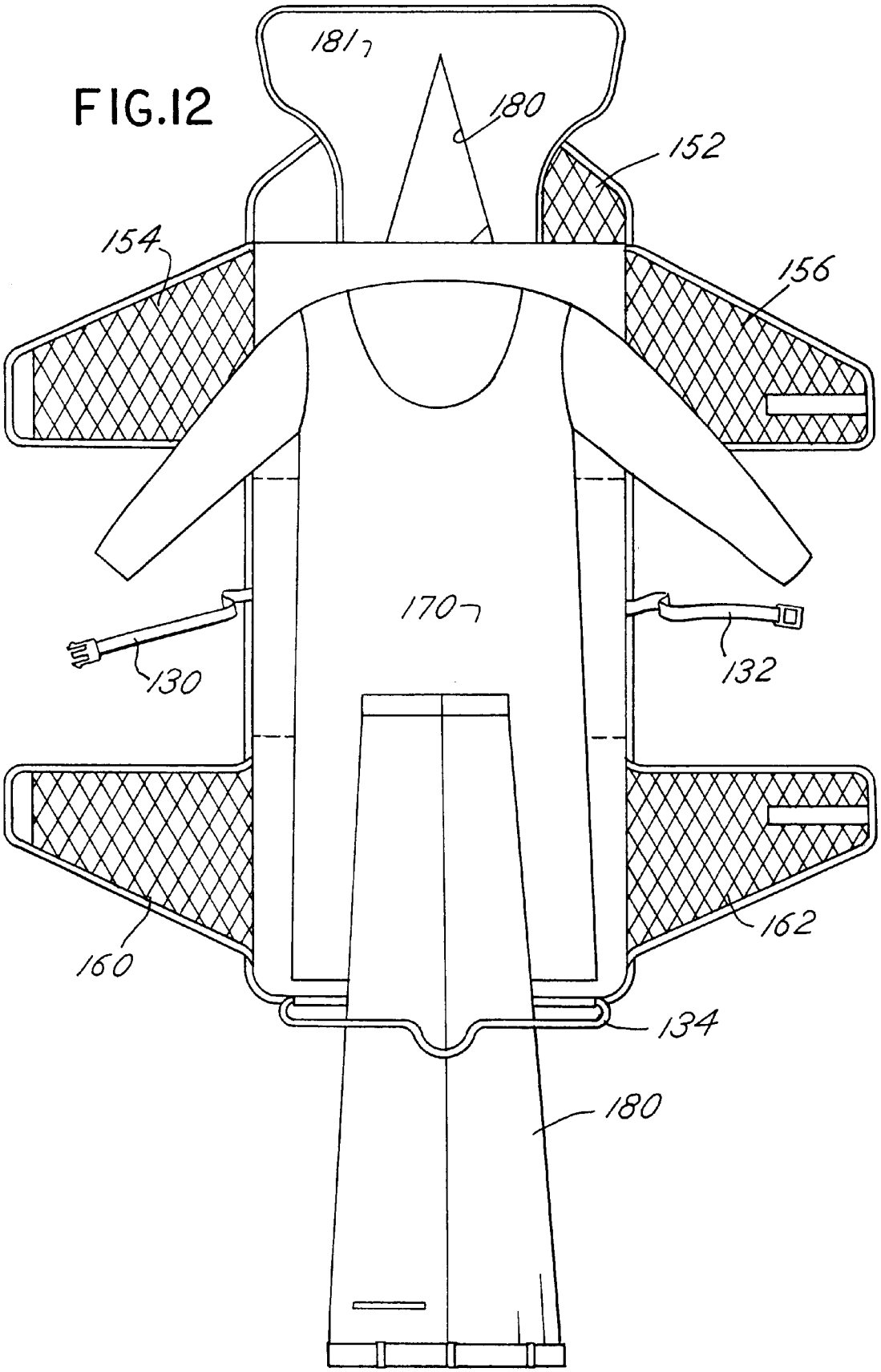
FIG. 12 is a plan view illustrating an alternative embodiment to the embodiment of FIG. 8 for folding of a collared dress and/or slacks.

The embodiment of FIGS. 12–16 is very similar to that of the previous embodiment of FIGS. 8–11. Like numbers refer to like parts. One of the distinct differences in the embodiment is the inclusion of a cutout section 180 in the flap 181 as depicted in FIG. 12. The cutout section 180 is provided to receive a collar, for example, associated with a dress or other article of clothing. The embodiment of FIGS. 12–16 thus has some additional flexibility in terms of its capability of utilization with respect to various types of garments.

Figure 13:
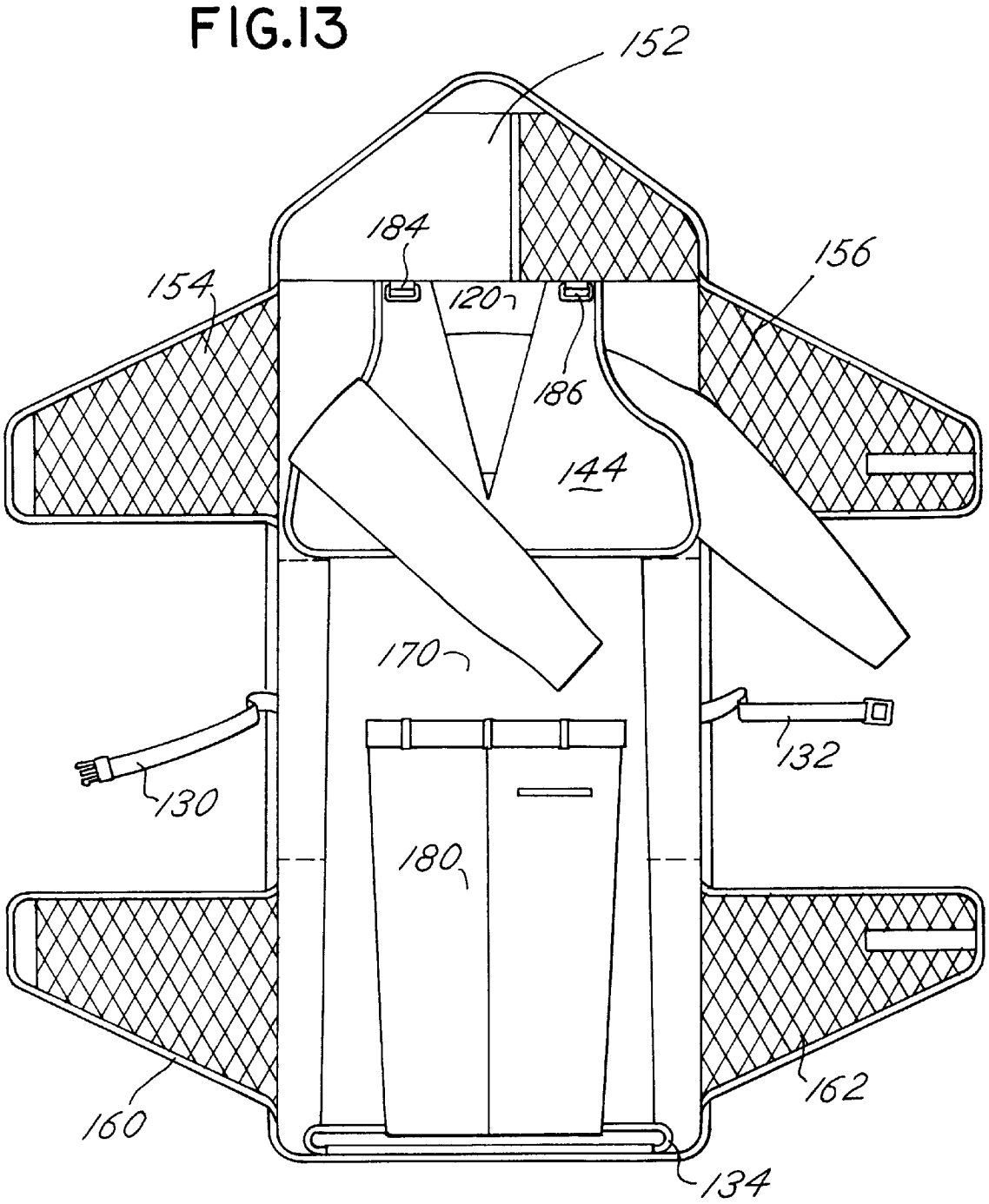
FIG. 13 is a plan view of the embodiment of FIG. 12 illustrating the next sequential step in the use of the embodiment.
Figure 14:
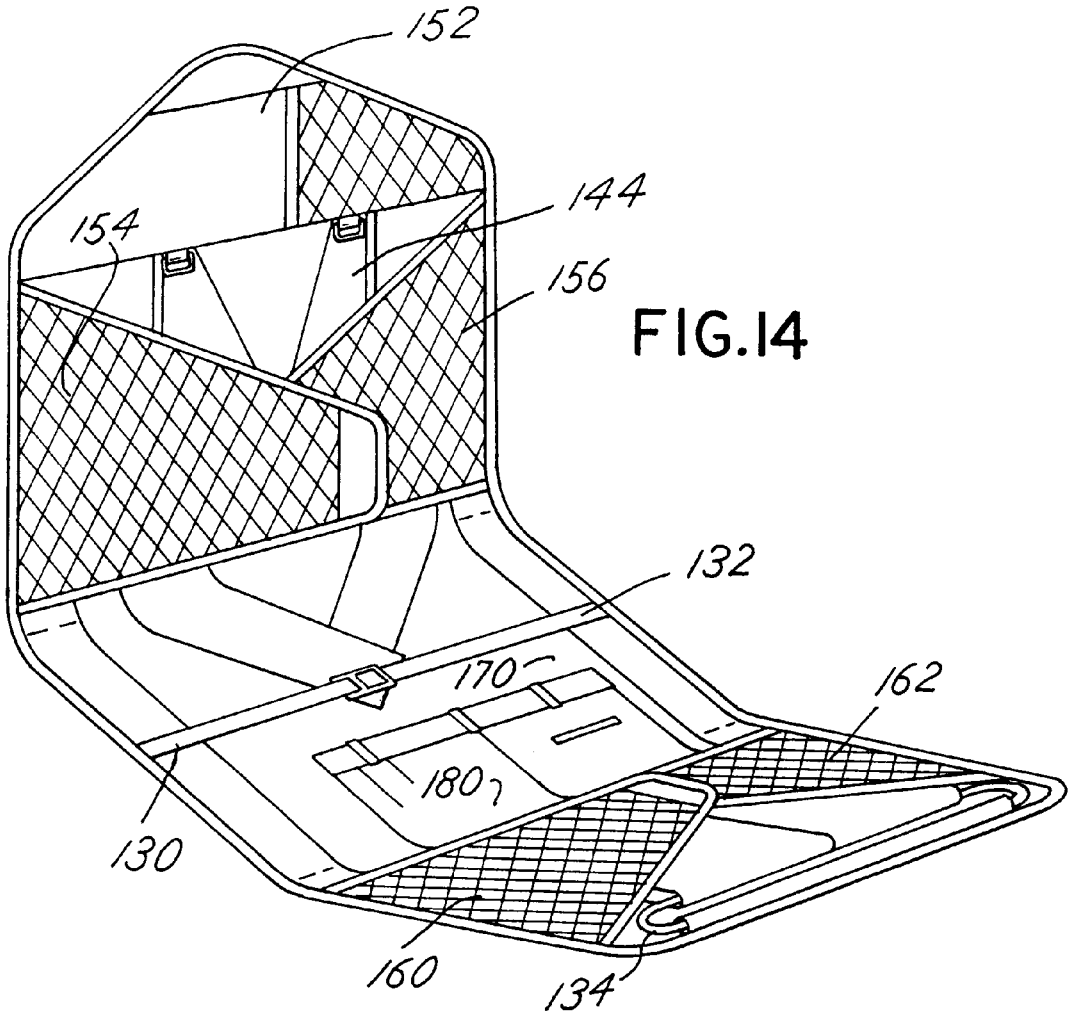
FIG. 14 is an isometric view of the embodiment of FIG. 12 illustrating the next sequential step in its use.
Figure 15:
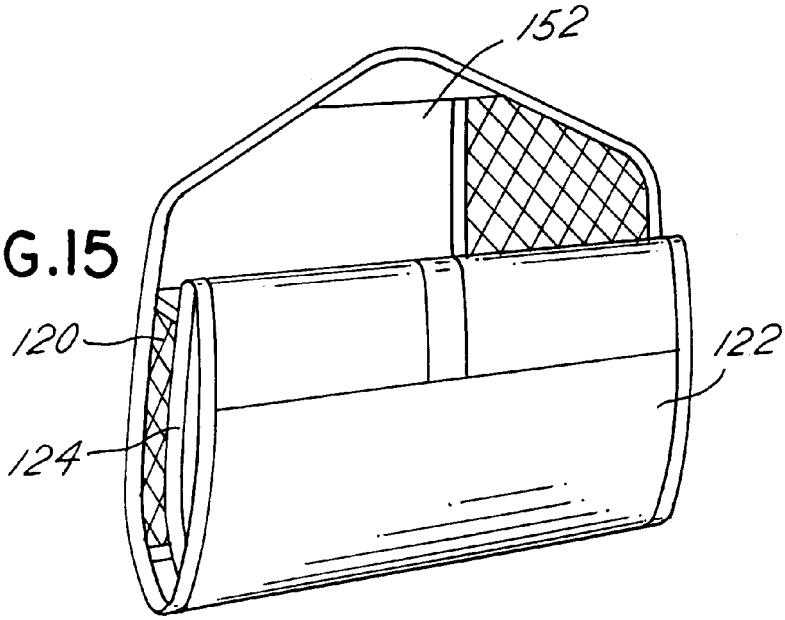
FIG. 15 illustrates in an isometric view the next sequential step in the operation or use in the embodiment of FIG. 12.
Figure 17:
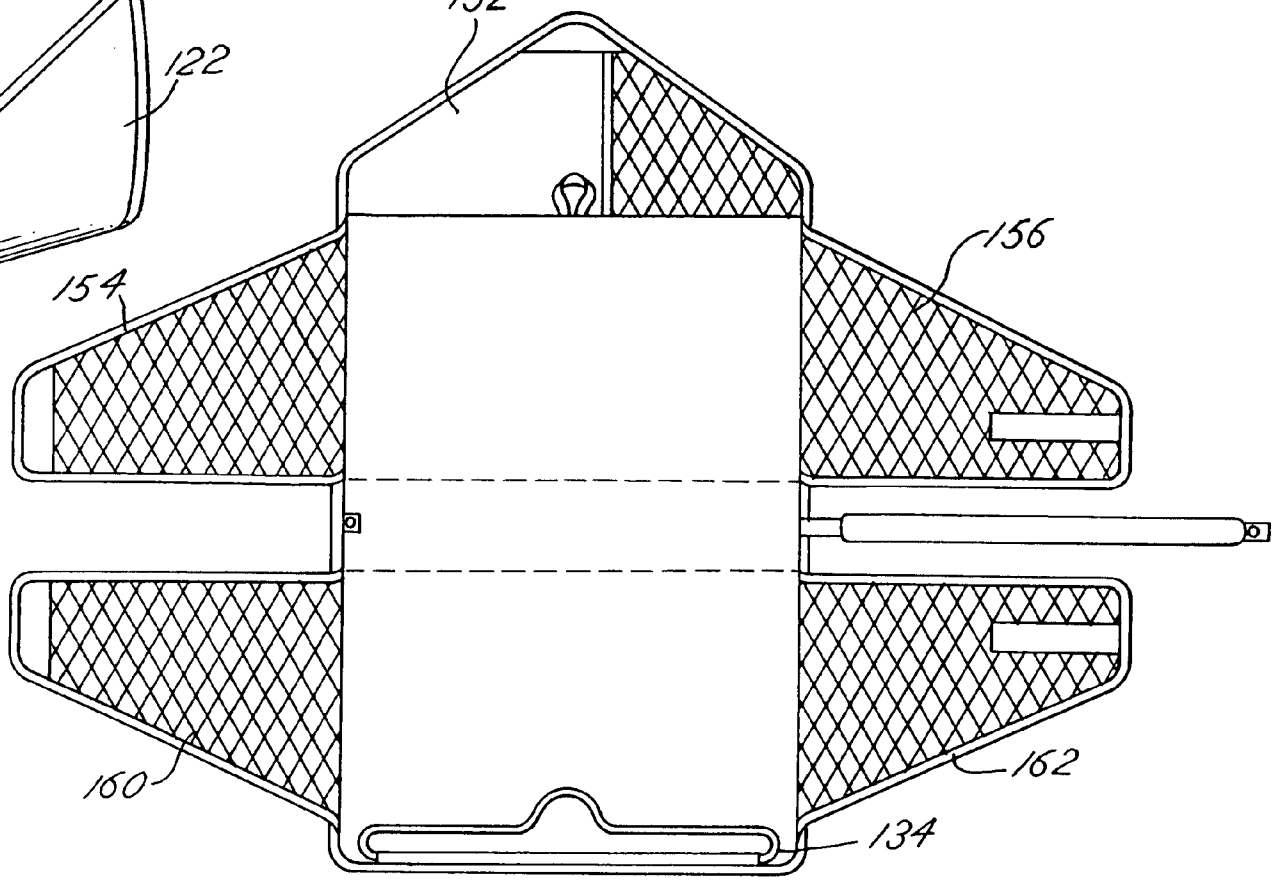
FIG. 17 is a plan view of another alternative embodiment which is especially useful for packing slacks.
Figure 16:
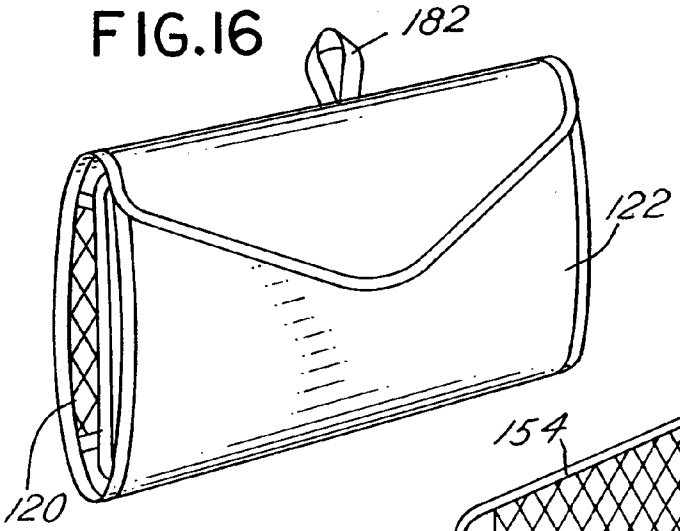
FIG. 16 is an isometric view illustrating a further step in the method of use in the embodiment of FIG. 12.

It is to be noted that optional hangers, such as hanger 182 in FIG. 16, may be utilized for hanging the package in its assembled condition. It is further observed that the connecting links 184 and 186, connecting the flap 144 to the center section 120 as depicted in FIG. 13, may be adjustable and, in fact, may be of a type which permits removal of the flap 144 if so desired.

Embodiment of FIGS. 17–22

Figure 18:
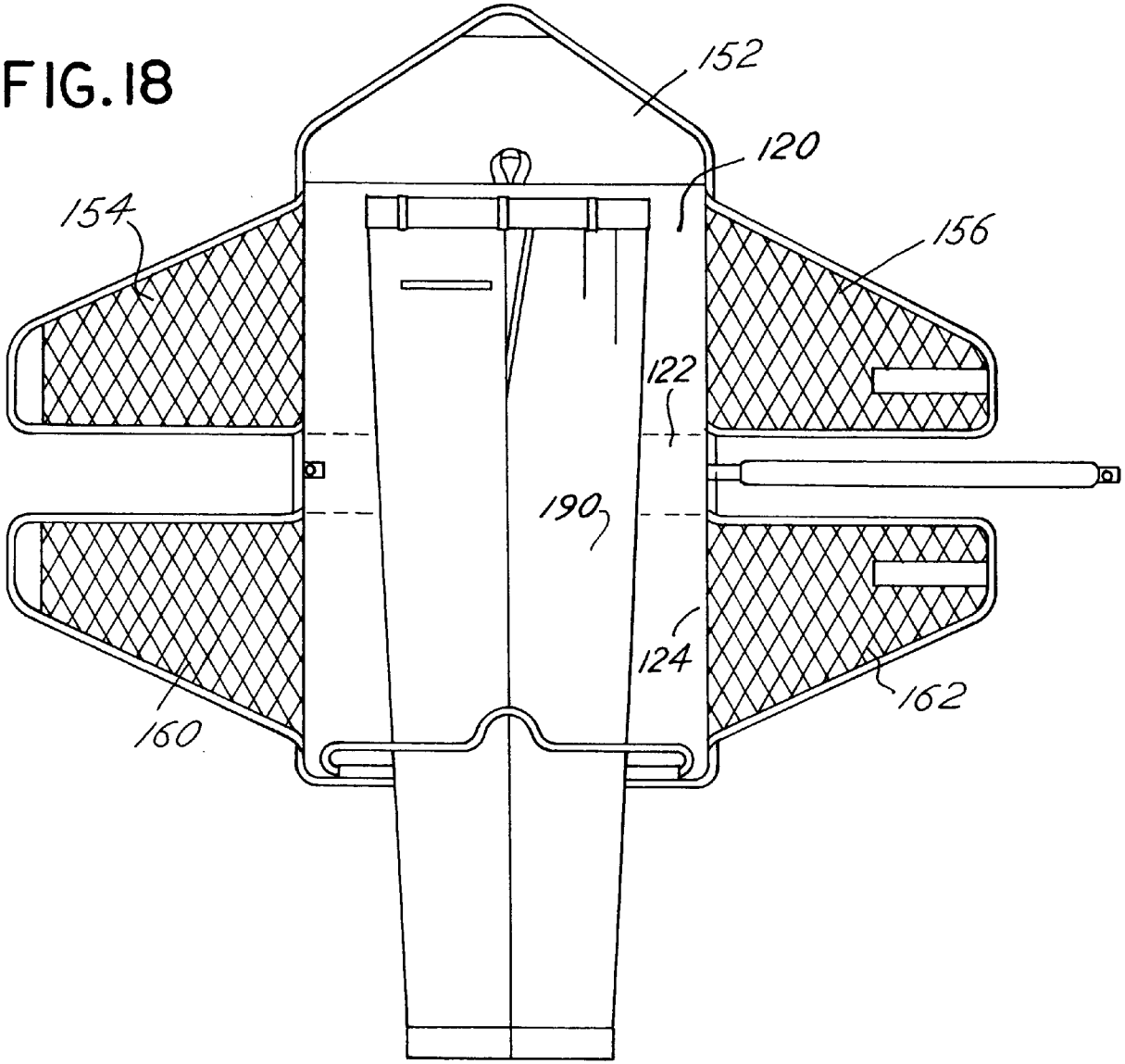
FIG. 18 is a top plan view of the embodiment of FIG. 17 wherein a pair of slacks has been positioned thereon.
Figure 19:
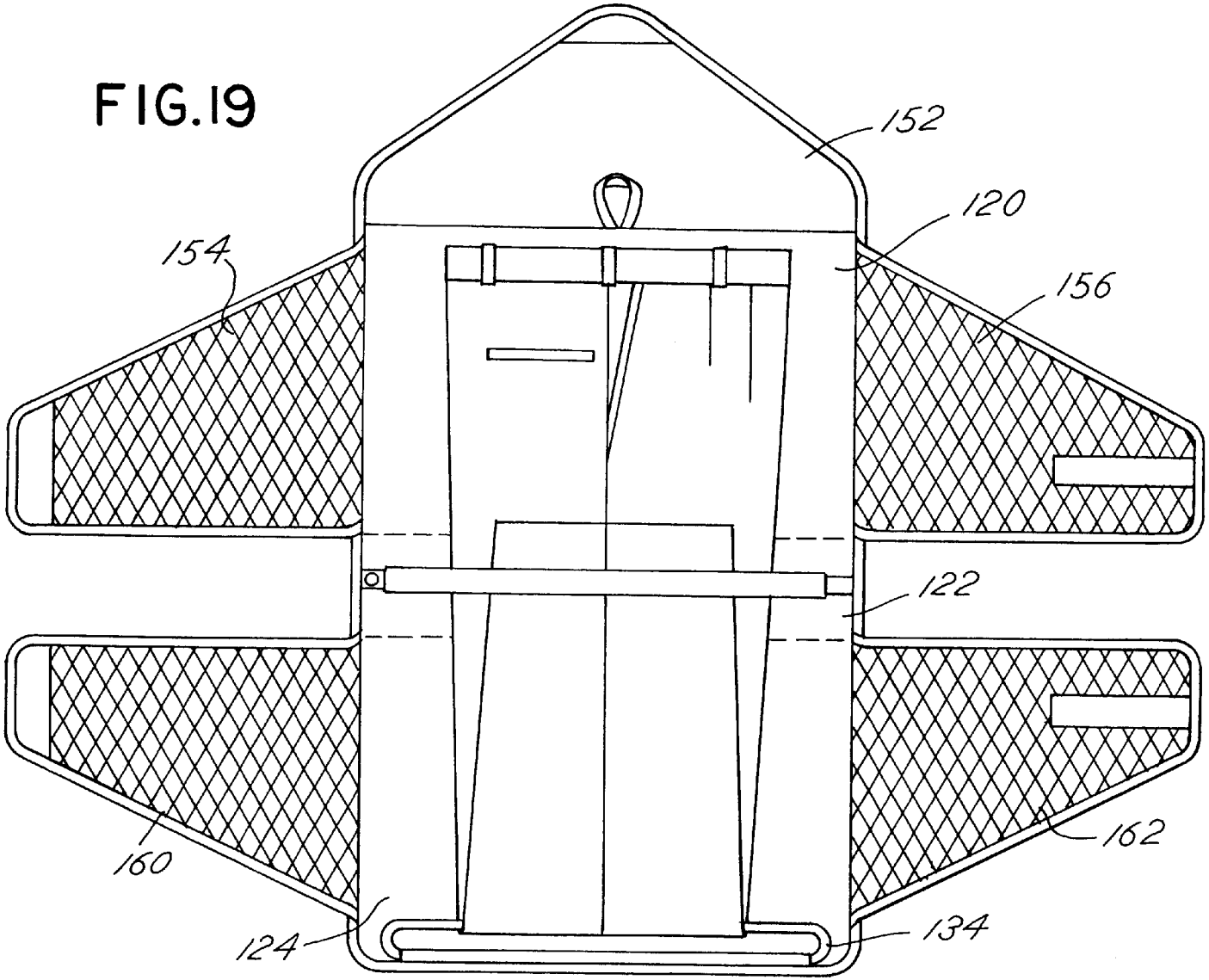
FIG. 19 is a plan view of the embodiment of FIG. 18 in a next sequential step in the method of utilization thereof.
Figure 22:
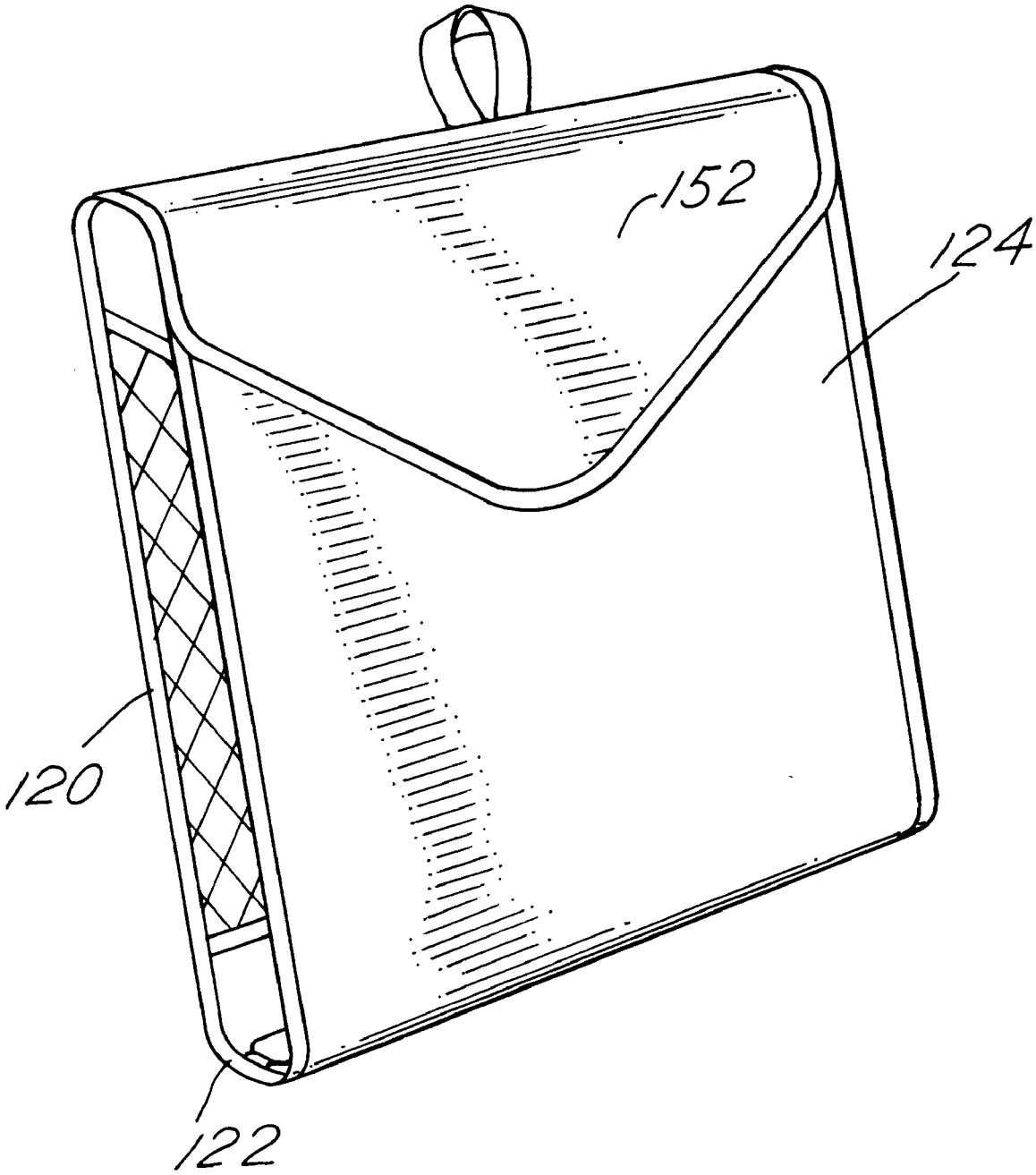
FIG. 22 is an isometric view of the folded package of the embodiment of FIG. 21.

In the embodiment of FIGS. 17–22, the flap 144 associated with the embodiment, for example of FIGS. 12–16, has been removed. Again, like parts are numbered in like manner in the FIGS. 17–22. The embodiment of FIGS. 17–22 is especially useful for the folding and maintaining of slacks, for example. As depicted in FIG. 18, a pair of slacks 190 may be positioned over sections 120, 122 and 124. It is noted that preferably the sections 120 and 124 are substantially equal in size so that they are totally congruent and overlie one another. They are thus of the same dimension. Additionally, the sections 120 and 124 in the embodiment of FIG. 18 are preferably rigid. Further, the connecting section 122 is generally flexible. Otherwise the component parts of FIGS. 17–22 are substantially the same as those in the earlier embodiment of FIGS. 12–16.

Again, various types of fasteners other than Velcro fasteners may be utilized to connect the elements or parts of the package. Additionally, as previously mentioned, various types of flaps in term of size and shape may be utilized along the edges such as the side edges 32 and 34 of center section 30 to achieve various angles and configurations for folded items depending upon the item which, in fact, is to be packaged or folded.

The assembly is preferably made of lightweight fabric. The rigid sections may comprise molded plastic boards sewn into a fabric which encircles and encompasses and thus protects the boards. Various other types of assembly of the configurations may be utilized. Thus there are many alternatives which are believed to be within the scope and spirit of the invention. The invention is therefore to be limited only by the following claims and equivalents thereof.

What is claimed is:

1. A packing case for foldable articles comprising, in combination:

a) a rigid, generally rectangular center section with a top side, opposite lateral sides and a bottom side, b) rigid wing means flexibly attached to the lateral sides for defining a pattern for folding an article positioned over the center section;

c) a generally rigid shaping member means flexibly attached to one of the remaining top or bottom sides of the center section for folding over the center section and also defining a pattern for folding an article positioned over the center section; and d) flexible side retainer wings attached to opposite side of the center section foldable over the center section and each other.

2. The case of claim 1 including a retaining flap attached to at least one of the sides of the center section and foldable over the center section.

3. The case of claim 2 wherein a first retaining flap is attached to the top side of the center section and a second retaining flap is attached to the bottom side of the center section.

4. The case of claim 3 including fastening means for attaching the retaining flaps to encapsulate articles folded over the center section.

5. The case of claim 1 wherein the rigid shaping member means is rectangular.

6. The case of claim 1 wherein the rigid shaping member means is attached by a flexible hinge to the center section.

7. The case of claim 1 wherein the rigid shaping member means is a member generally congruent with the center section.

8. The case of claim 1 wherein the side shaping wing means comprise wings which include an angled folding edge positioned providing a fold line for an article over the center section.

9. The case of claim 1 wherein the side shaping wing means are substantially identical in shape and are mirror images of each other when folded toward one another.

10. A packing case for foldable articles comprising, in combination:

an envelope having a rigid, generally rectangular center section having a top side, a bottom side, and opposite lateral sides;

a generally rigid shaping section flexibly hinged to one lateral side of the center section and foldable over the center section to retain an article on the center section; and a flexible retainer wing attached to each lateral side of the center section each retainer wing foldable over the center section and shaping section to retain articles positioned over the center section.

11. A packing case for foldable articles comprising, in combination:

an envelope having rigid center section having a top side, a bottom side and opposite lateral sides;

a generally rigid shaping section attached flexibly to one of the top or bottom sides of the center section and foldable over the center section;

at least one shaping wing flexibly attached to another side of the center section and foldable over the center section; and a flexible side retainer wing attached to each lateral side of the center section and foldable over the center section, shaping section and shaping wing to retain said center section, shaping section and shaping wing enclosed in a folded condition.

12. The case of claims 1, 10, or 11 further including a hanger member attached to the case.

13. The case of claim 11 wherein the shaping wing is foldable over the shaping section.

14. The case of claim 11 wherein the shaping section includes a scallop in the top edge for fitting over a collar of an article of clothing on the center section.

15. The case of claim 11 wherein the shaping section includes a center attachment portion to the top side of the center section and a scallop on each side of the attachment portion.

16. The case of claim 1 further including an attachment flap extending from, the bottom side of the center section and foldable over the center section.

17. The case of claim 16 wherein the attachment flap includes first and second lateral flap sides and further including first and second retaining flaps attached respectively to the first and second lateral flapsides, said flaps foldable over the attachment flap and an article on the flap to retain said article.

18. The case of claim 16 wherein the attachment flap includes a bottom edge generally aligned with an edge of the center section, and a loop member connected to the attachment flap at the bottom edge.

19. The case of claim 16 further including at least one retention strap connecting opposite sides of said center section.

20. A method of packing foldable articles comprising, in combination, the steps of:

positioning a foldable article over a rigid center section of a packing case of the type having a rigid center section with a top side, a bottom side and opposite lateral sides, a rigid shaping wing attached to a lateral side of the center section and foldable over said center section and a flexible side retainer wing attached to each lateral side and foldable over said center section and shaping wing;

positioning the shaping wing over an article on the center section;

folding the article over the shaping wing; and enclosing the article and shaping wing by folding the side retainer wings.

* * * * *

UNITED STATES PATENT AND TRADEMARK OFFICE

CERTIFICATE OF CORRECTION

PATENT NO. : 6,237,761 B1
DATED : May 29, 2001
INVENTOR(S) : Godshaw et al.

It is certified that error appears in the above-identified patent and that said Letters Patent is hereby corrected as shown below:

Column 8, claim 10,
Line 2, should read: -- center section, each retainer wing foldable over the --;

Column 8, claim 16,
Line 33, should read: -- flap extending from the bottom side of the center section --;

Column 8, claim 19,
Line 45, should read: -- The case of claim 1 or 16 further including at least one --.

Signed and Sealed this

Nineteenth Day of March, 2002

*Attest:*

*Attesting Officer*

JAMES E. ROGAN
*Director of the United States Patent and Trademark Office*